US005605288A

United States Patent [19]

McDonald

[11] Patent Number: 5,605,288

[45] Date of Patent: Feb. 25, 1997

[54] FILLING APPARATUS CLOG-FREE NOZZLE SCREEN

[75] Inventor: Kenneth P. McDonald, Union Lake, Mich.

[73] Assignee: Elopak Systems AG, Glattbrugg, Switzerland

[21] Appl. No.: 566,735

[22] Filed: Dec. 4, 1995

Related U.S. Application Data

[62] Division of Ser. No. 273,482, Jul. 11, 1994, Pat. No. 5,472,144.

[51] Int. Cl.[6] ..... B67C 3/22

[52] U.S. Cl. ..... 239/533.14; 239/107; 239/590.3; 239/DIG. 23; 138/37; 141/115

[58] Field of Search ..... 239/533.13, 533.14, 239/575, 553.3, 590.3, 515, 107, 104, 106, 120, 602, DIG. 23; 222/108, 189, 571; 141/115, 116, 259; 138/37, 40, 41; 137/67

[56] References Cited

U.S. PATENT DOCUMENTS

| | | | |
|---|---|---|---|
| 3,032,277 | 5/1962 | Petty | 239/590.3 X |
| 3,104,819 | 9/1963 | Aghnides | 239/533.13 X |
| 3,395,344 | 7/1968 | Bader | 239/533.13 X |
| 3,622,082 | 1/1971 | Tyre | 239/533.14 X |
| 3,672,574 | 6/1972 | Knapp | 239/428.5 |
| 4,135,670 | 1/1979 | Sugimito | 239/428.5 |
| 4,523,718 | 6/1985 | Pearson | 239/428.5 X |
| 4,859,336 | 8/1989 | Savas et al. | 222/189 X |

*Primary Examiner*—Kevin Weldon

*Attorney, Agent, or Firm*—Reising, Ethington, Barnard & Perry

[57] ABSTRACT

There is disclosed herein a fluid flow apparatus including a discharge nozzle arrangement comprising a single continuous, meandering stainless steel strand to create a planar screen operatively connected at its outer periphery to a diffuser chamber. The screen is adapted to retain a volume of fluid thereabove until the fluid is forced under pressure through the openings between adjacent segments of the strand. Portions of the screen are adapted to flex resiliently downwardly, out of the plane of the outer periphery, to provide additional clearances between adjacent segments of the screen, in the event particulates should tend to build-up, to thereby resist clogging by flushing same. The round cross-section of the strand facilitates continual cleanliness, and serves to produce better-behaved flow out of the nozzle, thereby reducing foaming of the product being discharged during the filling operation. As an alternate embodiment, broken line etched screen serve to provide the downward flexing feature when clogging tends to occur.

8 Claims, 3 Drawing Sheets

FILLING APPARATUS CLOG-FREE NOZZLE SCREEN

This is a division of application Ser. No. 08/273,482, filed on Jul. 11, 1994, now U.S. Pat. No. 5,472,144.

TECHNICAL FIELD

This invention relates generally to fluid flow apparatus, but more particularly to filler nozzles for filling liquid-carrying containers.

BACKGROUND ART

Devices for preventing liquid from flowing out of nozzle bodies under gravity have been addressed heretofore. For example, Ohta U.S. Pat. No. 4,958,669 discloses various spaced apart, perforated plate designs consisting of intersecting, connected warp and weft portions, for use within the discharge end of the nozzle body for the purpose described above. The suggested plates have a particular thickness and any of square, circular, triangular, or hexagonal etched-out openings formed therein, with a specified opening ratio of the total volume of the openings to the total volume, inclusive of the openings, of the etched plate.

Nelson U.S. Pat. No. 4,119,276 discloses a laminar stream faucet spout attachment including spaced apart perforated plates and nettings.

Kelly U.S. Pat. No. 3,415,294 discloses a plurality of relatively closely spaced fine mesh screens, separated by O-rings, at the discharge opening of a liquid filling machine for eliminating or minimizing the formation of foam as the liquid is poured through the screens into containers.

Each of Nelson U.S. Pat. No. 3,630,444 and Parkinson U.S. Pat. No. 3,730,439 disclose stacked, downwardly semi-spherical or concaval screens. Holden U.S. Pat. No. 2,643,104 and Nelson U.S. Pat. No. 4,730,786 disclose upwardly semispherical or concaval disc screens and/or cone screens.

McDonald U.S. application, Ser. No. 797,176, now abandoned assigned to the assignee of the instant invention, discloses stacked wave-shaped or dimpled, perforated plates, wherein separate spacers are not required.

Esper U.S. Pat. No. 5,335,862, assigned to the assignee of the instant invention, discloses closely wound coil springs of various configurations, wherein the coils are deflected downwardly so as to be urged apart under fluid pressure to permit flow therepast.

DISCLOSURE OF THE INVENTION

A general object of the invention is to provide an improved screen for a fluid flow duct, in particular an improved discharge nozzle for a fluid machine, especially an improved metal netting nozzle arrangement for a liquid filler assembly.

Another object of the invention is to provide an improved nozzle arrangement at the discharge end of a filler nozzle for preventing the liquid from flowing out of the nozzle body under gravity by the surface tension of the liquid, and adapted to being easily and efficiently cleaned in place and sanitized.

A further object of the invention is to provide variously shaped screens, formed by either a single, continuous, meandering strand, or a broken line nettings each serving as filler nozzles, and mounted in the discharge end of a nozzle body to serve the above mentioned function.

A still further object of the invention is to provide screens which may be formed by stainless steel strands, molded plastic, or etched plated. The stainless steel strands may be round cross-section wire, and the plastic may be molded with a round cross-section, while the etched plate would consist of square cross-section components.

Still another object of the invention is to provide such screens wherein the fluid is retained thereabove by the fluid surface tension until force is applied to discharge the fluid through the clearances, with downward deflection or flexing occurring as required to prevent build-up of particulates or pulpy products.

These and other objects and advantages will become more apparent when reference is made to the following drawings and the accompanying description.

BEST MODE OF CARRYING OUT THE INVENTION

Figure 1A:
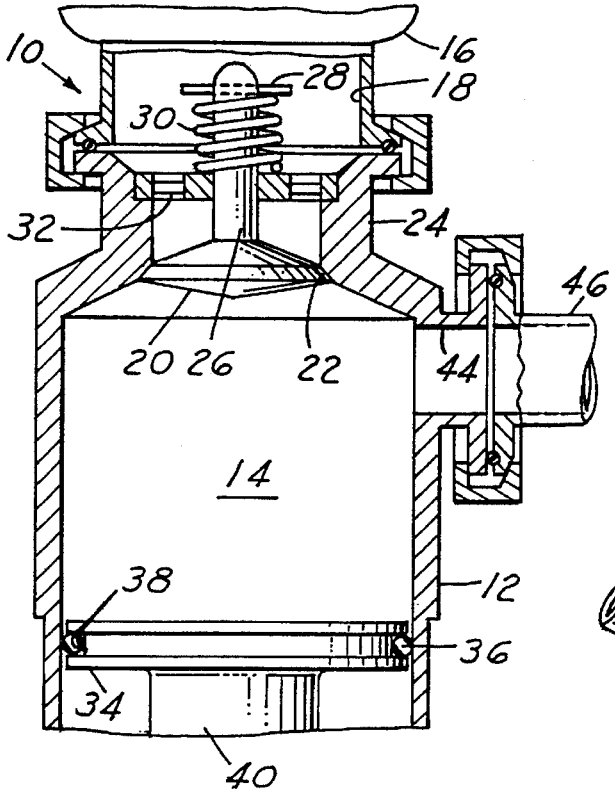
FIGS. 1A and 1B are fragmentary, vertical, axial sectional views of a filler apparatus embodying the invention.
Figure 1B:
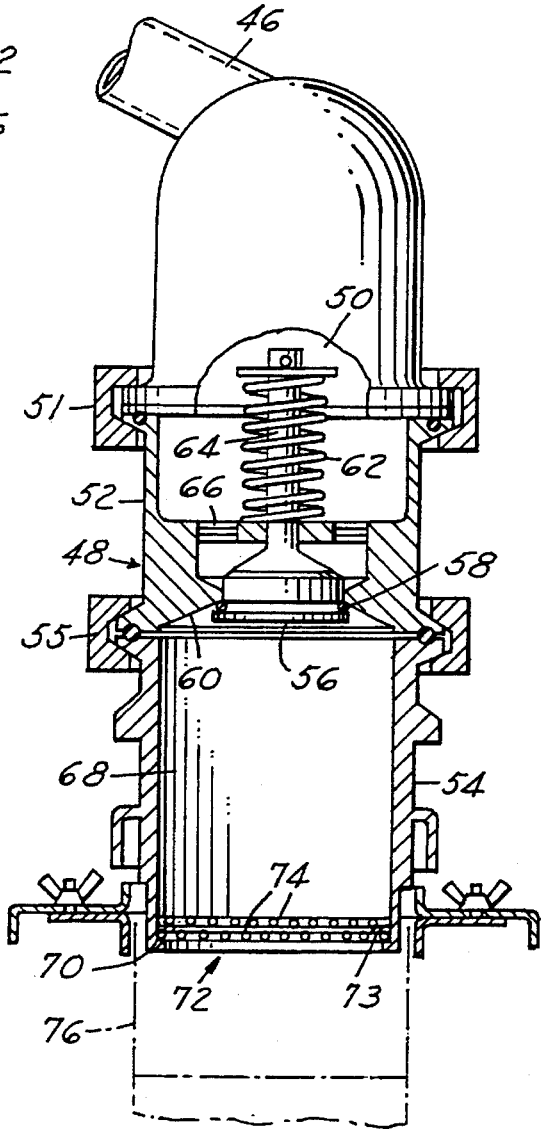

Referring now to the drawings in greater detail, FIGS. 1A and 1B illustrate a filler apparatus 10 including a filler body 12 having a chamber 14 therein for receiving a predetermined volume of liquid from an overhead tank, represented as 16, via a vertical passageway 18. A first check valve 20 cooperates with a seat 22 formed in a neck 24 at the upper end of the chamber 14. A valve stem 26 extends upwardly from the valve 20 through the neck 24 to be connected at the upper end 28 thereof to a spring 30 mounted at the lower end thereof on a fixed perforated member 32, so as to urge the valve 20 upwardly against the seat 22.

A piston 34 having an O-ring 36 mounted in a groove 38 formed around the periphery thereof, is slidably mounted in the chamber 14. A downwardly extending shaft 40 from the piston 34 is adapted to being connected to cylinder means (not shown). An outlet opening 44 is formed in the body 12, leading into a downwardly sloping elbow 46 to a nozzle body 48. A chamber portion 50 at the lower end of the elbow 46 is secured by suitable fasteners, represented as 51, to the nozzle body 48.

The nozzle body 48 includes a valve seat section 52 and a housing 54 secured together by suitable fasteners, represented as 55. A second check valve 56 having an O-ring 58 mounted thereon is co-operative with a seat 60 formed in the body 48 at the base of the valve seat section 52. A spring 62 is connected to a stem 64 extending upwardly from the valve 56. The spring 62 is mounted at its lower end thereof on a fixed perforated member 66 so as to urge the valve 56 and O-ring 58 upwardly against the seat 60.

The housing 54 includes a lower chamber 68 below the valve 56, terminating at a discharge end 70. Depending upon the application, one or multiple planar stainless steel screens 72 (FIG. 2) are mounted in the discharge end 70. The screens may be spaced apart by suitable spacers 73. The screens 72 may be formed by repeatedly bending a single continuous strand of stainless steel wire 74 into a predetermined meandering configuration. Alternately, the screens 72 may be molded with the suitable polymer. It will be noted that portions of each screen 72 form cantilevers 75, whereby, if and when some build-up of particulates occurs above those cantilevers, the resulting increased downward pressure thereon causes the cantilevers to flex resiliently downwards to allow the particulates to pass through the screen.

Figure 2:
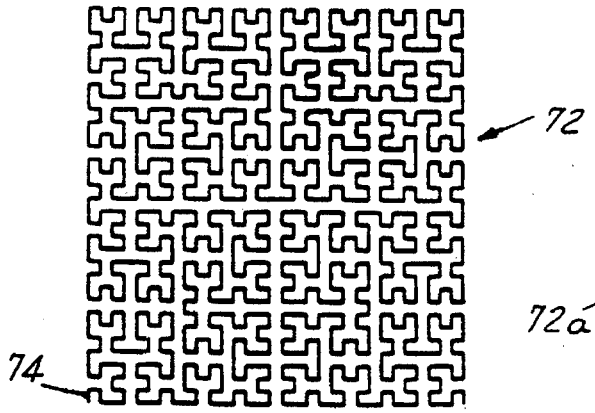
FIG. 2 to 6 are plan views of alternate, continuous, meandering, single-strand screens of the FIG. 1 apparatus.
Figure 3:
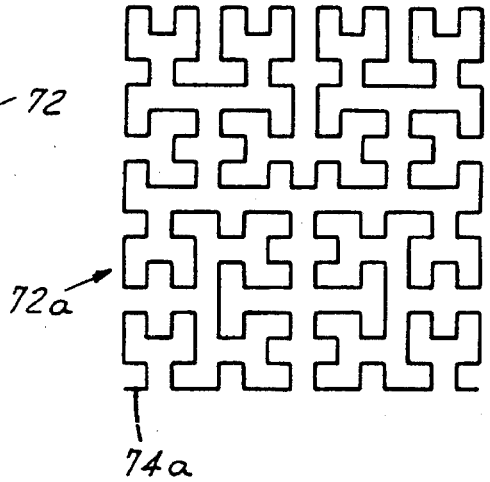

FIG. 3 illustrates a discharge screen 72*a* configuration similar to the screen 72 of FIG. 2, but with the path traversed by the strands thereof providing wider spaces between adjacent segments, so as to be suitable for thicker fluids, such as cream, buttermilk, or a pulpy product, for example.

Figure 4:
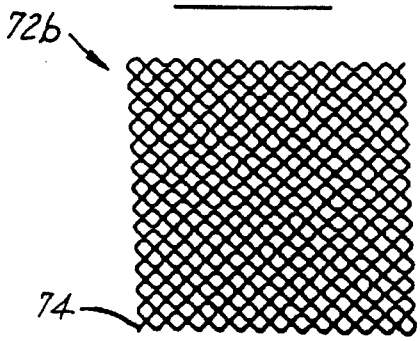
Figure 5:
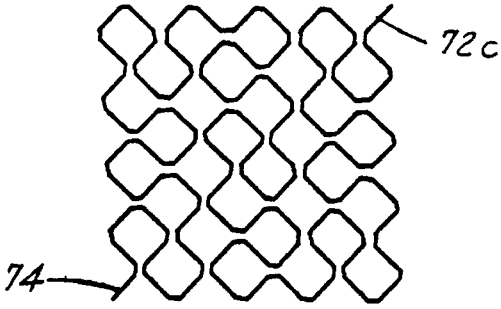

FIGS. 4 and 5 illustrate alternate fine and coarse meandering strand 74 configurations producing discharge screens 72*b* and 72*c*.

Figure 6:
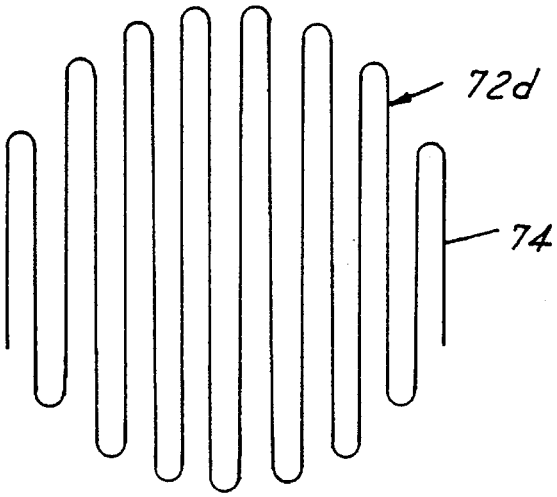

FIG. 6 illustrates still another alternate embodiment, wherein the strands 74 are formed to traverse a back-and-forth, substantially parallel and progressive path configuration producing a screen 72*d*.

As regards the spaces provided between adjacent segments of the single continuous, meandering path for each of the above described metal screen embodiments in its liquid-retaining condition, the areas of the individual spaces and the total area thereof, relative to the overall screen area, are such as to produce the result that surface tension of the liquid above the screen will prevent the liquid from flowing through the spaces under the force of gravity until a fluid force is applied thereto.

Figure 7:
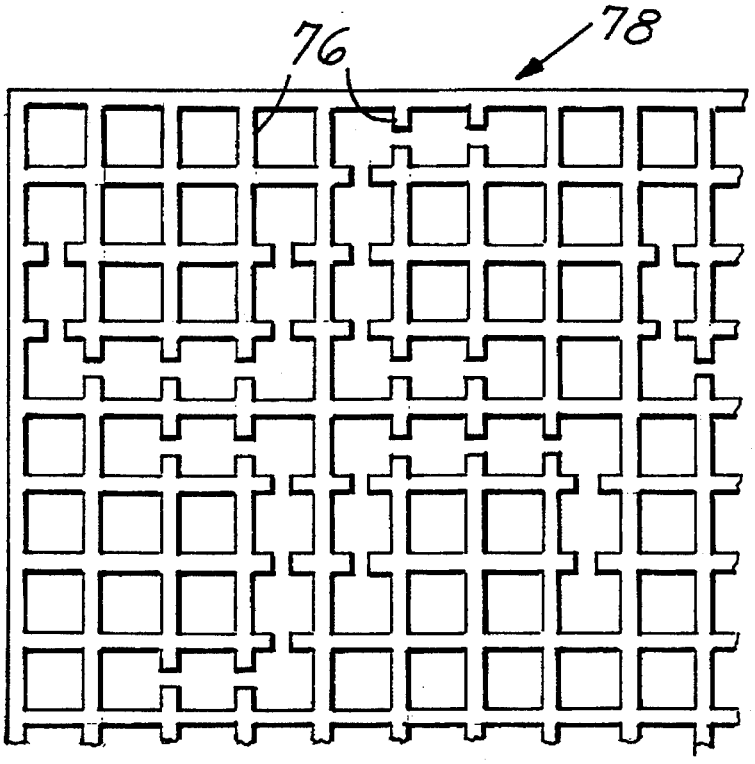
FIGS. 7 and 8 are enlarged, fragmentary, plan views of alternative, etched-plate screens of the FIG. 1 apparatus.
Figure 8:
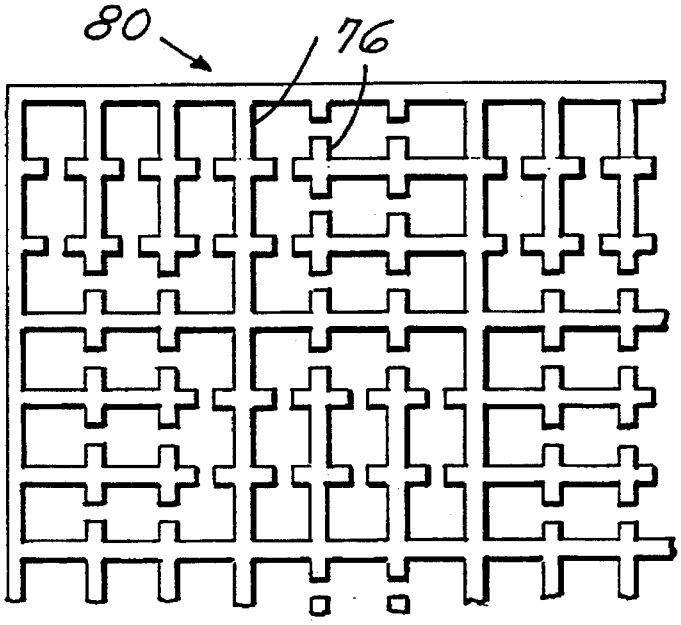

FIGS. 7 and 8 illustrate further embodiments made by etching stainless steel sheets to form respective discharge screens 78 and 80 comprised of broken-line, stainless steel, rectangular cross-section, links 76.

The overall operation of the filler assembly 10 is conventional, i.e., the filler assembly is first primed such that the chamber 14 and the nozzle body 48 chambers 50 and 68 are filled with a selected liquid product. The assembly is then ready for the production run. When cycled, the piston 34 moves upwardly, forcing a predetermined, measured volume of liquid from the chamber 14 through the outlet opening 44 and the sloping elbow 46 and, thence, into the valve seat section 52, lowering the check valve 56 (FIG. 1B). This, in turn, forces the equivalent volume of fluid from the lower chamber 68 through the spaces between adjacent segments of the screen(s), into a selected size carton, represented as 76 in FIG. 1B, positioned therebelow by the usual indexing conveyor and/or lifting mechanism (not shown). Conventional external means may be employed to raise and lower the carton 76 relative to the nozzle housing 54 for bottom-up filling applications.

Significant downward deflection or random area flexing of the screens 72, 72*a–d*, 78 and 80 will not occur unless and until some build-up of particulates, e.g. pulpy materials, begins to occur, at which time the resilient deflection or flexing will allow the build-up to pass through the resultant spread apart clearances.

Once the pumping stroke is completed, the spring 62 (FIG. 1B) urges the valve 56 and O-ring 58 upwardly into contact with the seat 60, with the chamber 68 remaining full. Retraction of the piston 34 (FIG. 1A) downwardly in the chamber 14 pulls the valve 20 away from the seat 22 to once again fill the chamber 14 with the selected volume of fluid, whereupon the spring 30 urges the valve 20 into contact with the seat 22, ready for the next cycle.

At this point, the various screens once again serve to retain the liquid in the nozzle chamber 68 by virtue of the surface tension of the liquid adjacent the screens.

If desired, instead of the screen lying in a planar surface transverse to the axis of the nozzle body, it may lie in a curved surface transverse to that axis.

INDUSTRIAL APPLICABILITY

It is apparent from the FIGS. 2–5, 7, 8 and 6 that any of the screen configurations may have an outer rectangular or circular formation, so as to accommodate particular chamber 68 discharge ends 70.

It should be apparent that the invention provides stainless steel or molded plastic screens, which may consist of round cross-section strands, in contrast to known woven netting packs having over-and-under lapped wires, and that the round cross-section single strand screens are particularly adaptable to easy cleanability compared with woven netting packs, and to producing a better-behaved flow out of the nozzle compared with etched plates, thereby reducing foaming of the product being discharged during the filling operation.

It should also be apparent that the invention provides a screen which will deform outwardly under sufficient pressure to allow particulates to pass through into the container, without clogging the screen, and then will resume its optimal planar configuration for smooth flow and shut-off.

While several embodiments have been shown and described, other modifications are possible within the scope of the following claims.

What is claimed is:

1. A nozzle for use at a chamber of a fluid machine, said nozzle comprising a screen formed of links lying in an imaginary surface and having clearances among adjacent links, with selected pluralities of intersecting rows of links being broken to form cantilevers, and operatively connected to said chamber, characterized by said screen being adapted to (1) retain fluid thereabove under the fluid's surface tension, (2) when a downward force is applied to said fluid, to permit the fluid to flow through said clearances while the screen substantially remains lying in said imaginary surface, and (3), in the event of build-up of particulates, the underlying cantilevers adapted to randomly flex downwardly to permit the particulates to pass through resultant spread apart clearances.

2. A nozzle according to claim 1, wherein said screen is formed by etching a metal plate to produce the links and broken links.

3. A nozzle according to claim 2, wherein said perforated plate includes square cross-section links.

4. A nozzle according to claim 1, wherein said screen is connected at its outer periphery to said chamber.

5. A nozzle according to claim 1, wherein said screen is rectangular in shape at its outer periphery.

6. Apparatus comprising a fluid flow duct having a longitudinal axis, and a screen disposed in the path of fluid flow through said duct, characterised in that said screen comprises a plurality of interconnected links, with predetermined intersecting rows of links being broken to thereby form cantilevers lying substantially in an imaginary surface transverse to said longitudinal axis and resiliently turnable out of said imaginary surface.

7. Apparatus according to claim 6, wherein said screen consists of a continuous elongate element which lies and meanders substantially in said imaginary surface.

8. Apparatus according to claim 6, where said screen serves to retain fluid thereabove under surface tension of said fluid.

* * * * *